US009717357B2

(12) United States Patent
Johnson et al.

(10) Patent No.: US 9,717,357 B2
(45) Date of Patent: Aug. 1, 2017

(54) MANAGING A CONDITION OF A SELECTION OF CLOTHING ITEMS

(71) Applicant: INTERNATIONAL BUSINESS MACHINES CORPORATION, Armonk, NY (US)

(72) Inventors: Michael C. Johnson, Essex Junction, VT (US); Travis Longenbach, Essex Junction, VT (US); Nicolas E. Pizzuti, Essex Junction, VT (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 14/788,314

(22) Filed: Jun. 30, 2015

(65) Prior Publication Data

US 2017/0000277 A1 Jan. 5, 2017

(51) Int. Cl.
*G08B 21/18* (2006.01)
*A47G 25/14* (2006.01)

(52) U.S. Cl.
CPC ..... *A47G 25/1407* (2013.01); *G08B 21/18* (2013.01)

(58) Field of Classification Search
CPC ..... G08B 19/00
See application file for complete search history.

(56) References Cited

U.S. PATENT DOCUMENTS 5,797,527 A 8/1998 Lam
5,809,470 A 9/1998 Monjo
6,032,838 A * 3/2000 Maher ..... A47G 25/1407 177/264
6,149,038 A 11/2000 Tsai
D527,194 S 8/2006 Yau
(Continued)

FOREIGN PATENT DOCUMENTS

GB 2507323 A 4/2014
KR 2013070669 A 6/2013
WO WO2014073983 A1 5/2014

OTHER PUBLICATIONS

Van et al.; "An Implementation Of Laundry management System Based On RFID Hanger And Wireless Sensor Network", Ubiquitous and Future Networks (ICUFN), IEEE Fourth International Conference On, Jul. 4-6, 2012, pp. 490-493.
ip.com et al.; "Smart Hanger—Method To Track Duration Since Last Use In Clothing Items", IPCOM0002310181D, Sep. 25, 2013, pp. 1-2.
(Continued)

*Primary Examiner* — Joseph Feild
*Assistant Examiner* — John Mortell

(57) ABSTRACT

A monitoring system including one or more processors communicatively connected with a memory, one or more output interfaces, one or more connectivity interfaces and one or more sensors, is attached to a clothing frame. The one or more sensors sense one or more indicators of a status of a clothing item attached to the clothing frame, the one or more sensors attached to the clothing frame and connected to one or more processors, one or more output interfaces, and one or more connectivity interfaces. The monitoring system determines the status information for the clothing item based on the one or more indicators. The monitoring system selectively adjusts an output interface to display the status information. The monitoring system communicates the status information to one or more additional clothing frames via the one or more connectivity interfaces.

18 Claims, 8 Drawing Sheets

(56) References Cited

U.S. PATENT DOCUMENTS

| | | | | |
|---|---|---|---|---|
| 7,084,769 | B2 | 8/2006 | Bauer et al. | |
| 7,228,995 | B2 | 6/2007 | Carty | |
| 7,246,730 | B2 | 7/2007 | Russo | |
| 8,534,513 | B1 | 9/2013 | Dixon | |
| 8,627,584 | B2 | 1/2014 | Aiezza | |
| 2002/0037235 | A1 | 3/2002 | Khatchatrian et al. | |
| 2003/0216969 | A1* | 11/2003 | Bauer | G06K 7/0008 705/22 |
| 2011/0309931 | A1* | 12/2011 | Rose | E21F 17/18 340/539.13 |
| 2012/0326887 | A1 | 12/2012 | Inoko | |
| 2013/0128023 | A1 | 5/2013 | Vock | |
| 2014/0159872 | A1* | 6/2014 | Bekritsky | G06K 7/10079 340/10.5 |
| 2014/0299663 | A1* | 10/2014 | Shah | G06K 7/065 235/385 |

OTHER PUBLICATIONS

Toney et al.; "Managing Smart Garments", Wearable Computers, 2006 10th IEEE International Symposium On, Oct. 11-14, 2006, pp. 91-94.

Wong et al.; "A Three In One Smart Garment Hanger", System Science And Engineering (ICSSE), 2010 IEEE International Conference On, Jul. 1-3, 2010, pp. 50-55.

Technogadget, "Smart Wardrobe" Recommends Fashion, Tracks Outfits, Nov. 21, 2007, accessed online via <http://www.trendhunter.com/trends/intelligent-closet-smart-wardrobe> as of Jun. 30, 2015, 4 pages.

Scharf, "The C&A Facebook Hangers Provide Mass Feedback to Shoppers," May 7, 2012, accessed online via <http://www.trendhunter.com/trends/facebook-hangers> as of Jun. 30, 2015, 4 pages.

Love, Allison, "The Coat Rack's Barometric Display Picks Out Weather-Appropriate Coats", May 5, 2010, accessed online via <http://www.trendhunter.com/trends/the-coat-rack>, 4 pages.

* cited by examiner

MANAGING A CONDITION OF A SELECTION OF CLOTHING ITEMS

BACKGROUND

1. Technical Field

The embodiment of the invention relates generally to sensors and particularly to managing a condition of a selection of clothing items through sensors for tracking indicators of status information for each of the clothing items placed on clothing frames in the collection.

2. Description of the Related Art

Whether stored in a home, retail store, or warehouse, when clothing items are stored, the condition and seasonal applicability of the clothing items may change over time.

BRIEF SUMMARY

Whether a selection of clothing items in a space is small or large, managing the condition of the selection of clothing items so that it is maintained, wearable, and relevant for a current season may be time consuming. Therefore, in view of the foregoing, there is a need for a method, system, and computer program product for managing a condition of a selection of clothing items through sensors for tracking status information for each of the clothing items placed on clothing frames in the collection.

In one embodiment, a system comprises one or more processors communicatively connected with a memory, one or more output interfaces, one or more connectivity interfaces and one or more sensors attached to a clothing frame. The system comprises the one or more sensors operative to sense one or more indicators of a status of a clothing item attached to the clothing frame. The system comprises the one or more processors operative to determine status information for the clothing item based on the one or more indicators. The system comprises the one or more processors operative to selectively adjust an output interface to display the status information. The system comprises the one or more processors operative to communicate the status information to one or more additional clothing frames via the one or more connectivity interfaces.

In another embodiment, a method is directed to attaching a monitoring system comprising one or more processors communicatively connected with a memory, one or more output interfaces, one or more connectivity interfaces and one or more sensors, to a clothing frame. The method is directed to sensing, by one or more sensors, one or more indicators of a status of a clothing item attached to the clothing frame, the one or more sensors attached to the clothing frame and connected to one or more processors, one or more output interfaces, and one or more connectivity interfaces. The method is directed to determining, by the one or more processors, status information for the clothing item based on the one or more indicators. The method is directed to selectively adjusting, by the one or more processors, an output interface to display the status information. The method is directed to communicating, by the one or more processors, the status information to one or more additional clothing frames via the one or more connectivity interfaces.

In another embodiment, a method is directed to attaching a monitoring system to a clothing frame, the monitoring system comprising one or more processors, one or more output interfaces, one or more connectivity interfaces, and one or more sensors to sense status information about a clothing item temporarily attached to the clothing frame and control outputs of the sensed status information through the one or more output interfaces. The method is directed to communicating, by the monitoring system, through short range wireless broadcasting with one or more additional monitoring systems each attached to a separate clothing frame from among one or more additional clothing frames and sensing additional status information about one or more additional clothing items temporarily attached to each of the one or more additional clothing frames and to control outputs of the additional status information through each of the one or more additional output interfaces. The method is directed to adjusting, by the monitoring system, the outputs to the one or more output interfaces based on additional status information, to manage a plurality of clothing items comprising the clothing item and the one or more additional clothing items.

BRIEF DESCRIPTION OF THE SEVERAL VIEWS OF THE DRAWINGS

The novel features believed characteristic of one or more embodiments of the invention are set forth in the appended claims. The one or more embodiments of the invention itself however, will best be understood by reference to the following detailed description of an illustrative embodiment when read in conjunction with the accompanying drawings, wherein:

DETAILED DESCRIPTION

In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

In addition, in the following description, for purposes of explanation, numerous systems are described. It is important to note, and it will be apparent to one skilled in the art, that the present invention may execute in a variety of systems, including a variety of computer systems and electronic devices operating any number of different types of operating systems.

Figure 1:
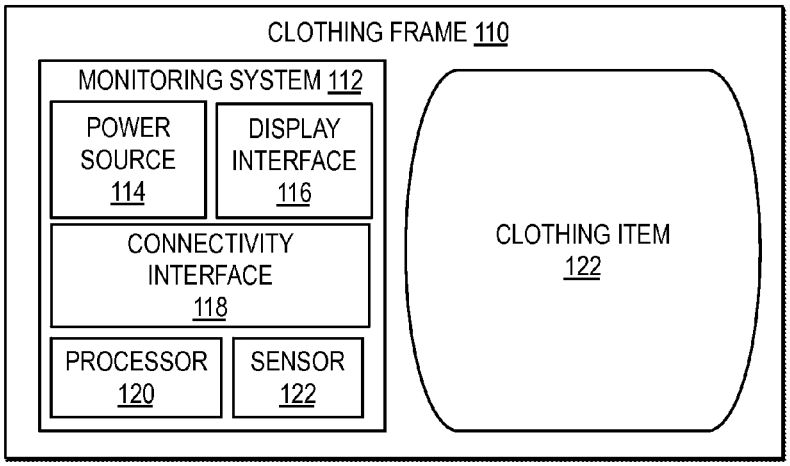
FIG. 1 illustrates one example of block diagram of a clothing frame configured with a monitoring system for monitoring and reporting status information about a clothing item temporarily attached to the clothing frame.

FIG. 1 illustrates a block diagram of one example of a clothing frame configured with a monitoring system for monitoring and reporting status information about a clothing item temporarily attached to the clothing frame.

In one example, a clothing frame 110 may represent one or more framed structures on which a clothing item may be hung, such as, but not limited to, a hanger. In one example, clothing frame 110 may be composed of one or more types of materials including, but not limited to, metal, plastic, rubber, and wood configured into one or more frame configurations.

In one example, one or more clothing items may be temporarily attached on clothing frame 110. In one example, clothing item 122 may be temporarily attached to clothing frame 110 by hanging, tying, folding, affixing, sliding, clipping, or other attachment to one or more components of clothing frame 110.

In one example, clothing frame 110 may be configured with a monitoring system 112 operative to monitor for one or more types of status information of one or more clothing items attached to clothing frame 110. In one example, clothing frame 110 may include one or more types of sensors, such as sensor 122, for sensing indicators of one or more types of status information about clothing frame 110 and about any clothing item currently attached to clothing frame 110, such as clothing item 122.

In one example, monitoring system 112 may also include a power source 114 for powering one or more components of monitoring system 112, a processor 120 for processing the indicators of one or more types of status information from sensor 122 and controlling output of the status information to one or more interfaces, such as a display interface 116 and a connectivity interface 118. In one example, connectivity interface 118 may represent an interface for wirelessly connecting with another clothing frame or with another system, via a wireless network connection.

In one example, power source 114 may represent a mechanism for providing electricity to embedded electronic devices of monitoring system 112 through one or more types of components. In one example, power source 114 may be implemented through an energy storage device, such as, but not limited to, one or more batteries or a super capacitor bank. In one example, power source 114 may be implemented through a receiver capable of capturing and providing wireless energy. In one example, power source 114 may be implemented through a mechanism that provides a path for energy to flow from a horizontal conductive bar that clothing frame 110 is hung from.

In one example, monitoring system 112 may include display interface 116, which may represent an output interface affixed to clothing frame 110 for displaying status information. In one example, display interface 116 may include one or more display components including, but not limited to, one or more light emitting diodes (LEDs) dispersed along clothing frame 110 and a pixel-based visual display, such as an LED or OLED screen. In one example, components of display interface 116 may be embedded within the structure of clothing frame 110 or may be temporarily or permanently affixed to the structure of clothing frame 110. In one example, components of display interface 116, such as LEDs, are positioned such that when a clothing item is attached to clothing frame 110 in the manner that the clothing item is intended to be attached, the LEDs are still visible. In one example, display interface 116 may include display components that are lightweight and low cost, to minimize the weight and cost of the display components attached to each clothing frame. In the example, through outputs within display interface 116, clothing frame 110 individually directly provides a user with status information about any clothing items temporarily attached to clothing frame 110.

In one example, monitoring system 112 may function as a standalone hangar for providing a user with status information for performing one or more functions that enable managing a condition of clothing items. Monitoring system 112 may perform one or more functions including, but not limited to, wardrobe tracking and organization, odor and mold monitoring, and creation and display of status information. In one example, clothing frame 110 may function as a standalone hanger for providing a user with status information about the condition of any clothing items temporarily attached to clothing frame 110 to provide information for managing a condition of a wardrobe. In addition, clothing frame 110, when used in conjunction with one or more additional clothing frames configured with monitoring systems, provides a system for managing a condition of a selection of clothing items temporarily attached to the clothing frames.

Figure 2:
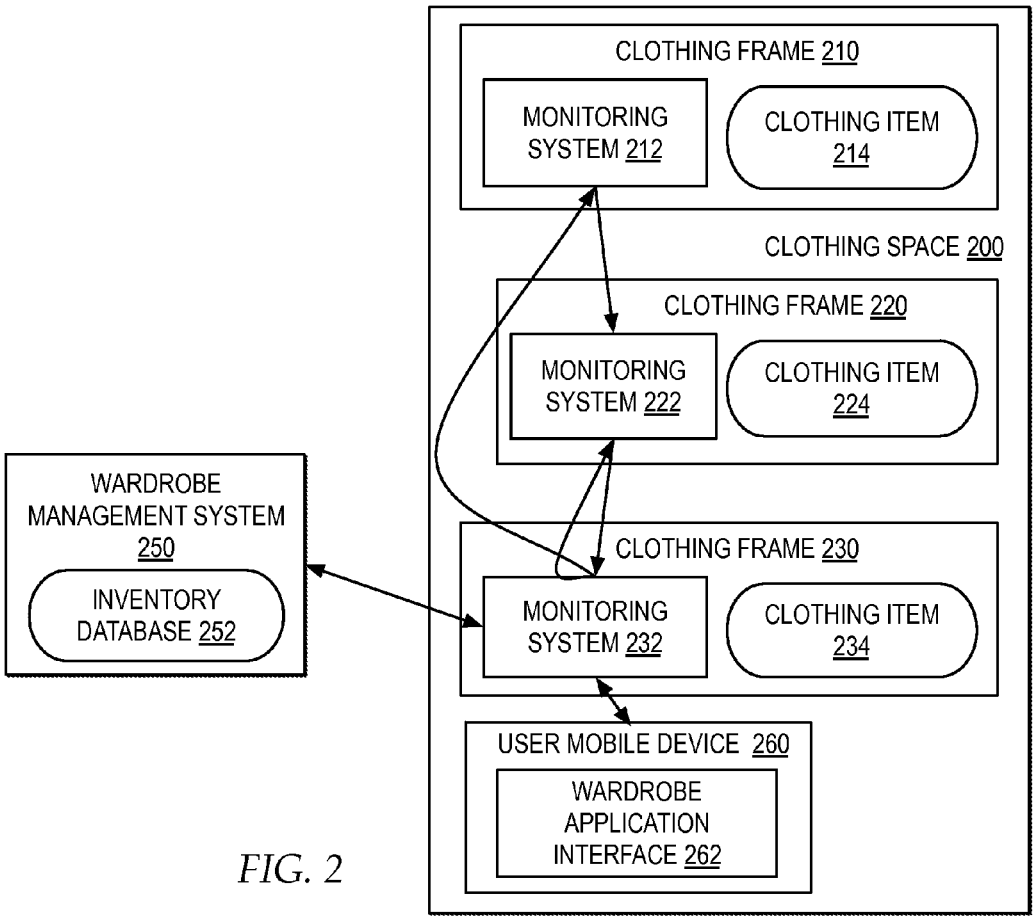
FIG. 2 illustrates one example of a block diagram of multiple clothing frames arranged within a clothing space and further illustrating communicative connections between one or more clothing frames, an external wardrobe management system, and a user mobile device.

FIG. 2 illustrates one example of a block diagram of multiple clothing frames arranged within a clothing space and further illustrating communicative connections between one or more clothing frames, an external wardrobe management system, and a user mobile device.

In one example, a clothing space 200 includes one or more clothing frames, such as clothing frame 110, illustrated for example, as a clothing frame 210, a clothing frame 220, and a clothing frame 230. In one example, each of clothing frame 210, clothing frame 220, and clothing frame 230 may include separate instances of one or more components of monitoring system 112, illustrated by a monitoring system 212 of clothing frame 210, a monitoring system 222 of clothing frame 220, and a monitoring system 232 of clothing frame 230. In one example, one or more separate clothing items may be temporarily attached to each of clothing frame 210, clothing frame 220, and clothing frame 230, illustrated by a clothing item 214 temporarily attached to clothing frame 210, a clothing item 224 temporarily attached to clothing frame 220, and a clothing item 234 temporarily attached to clothing frame 230.

In one example, the connectivity interface of each monitoring system of each clothing frame may be specified for one or more ranges of connectivity including, but not limited to, short range wireless connectivity, wireless local area network (WLAN) connectivity, and cellular network connectivity. In one example, short range wireless connectivity may be supported by one or more wireless network technologies such as, but not limited to, bluetooth, which is a wireless technology standard for exchanging data over short distances from fixed and mobile devices. In one example, short range, local wireless connectivity may include one or more of broadcasting status information and detecting broadcast status information over one or more local wireless broadcast networks. In one example, wireless connectivity may include one or more of transmitting status information and receiving status information over more or more wireless transmission networks.

In one example, each connectivity interface specified for short range wireless connectivity may broadcast at a same range or at different ranges. In one example, a connectivity interface of monitoring system 212 locally broadcasts status information within a short range broadcast area that is within a first range detectable by a connectivity interface of monitoring system 222. In another example, the connectivity interface of monitoring system 222 locally broadcasts status information within a short range broadcast area that is within a second range detectable by a connectivity interface of monitoring system 232. In another example, the connectivity interface of monitoring system 232 broadcasts status information within a short range broadcast area that is within a third range detectable by the connectivity interfaces of monitoring system 212 and monitoring system 222.

In one example, the connectivity interface of monitoring system 232 may transmit status information through a WLAN to a network to which one or more systems are connected, such as a wardrobe management system 250. In one example, wardrobe management system 250 may be configured to receive status information transmitted by a single clothing frame or from multiple clothing frames. In one example, one a particular frame, such as clothing frame 230, may be specified for transmitting the status information for clothing frame 230 and the status information collected from short range broadcasts from other clothing frames, such as clothing frame 230 and clothing frame 220. In one example, wardrobe management system 250 may receive status information from one or more clothing frames and maintain an inventory database 252 with an entry for each clothing item detected within clothing space 200, with status information updates tracked by clothing item.

In addition, wardrobe management system 250 may be specified to transmit status information or specifications to one or more monitoring systems within clothing space 200. In one example, the connectivity interface of monitoring system 232 may be specified to receive wireless transmissions from wardrobe management system 250. The connectivity interface of monitoring system 232 may also be specified to broadcast the status information or specifications received from wardrobe management system 250 within a short range broadcast area that may be monitored by one or more connectivity interfaces of one or more additional clothing frames.

In one example, wardrobe management system 250 may also transmit status information for clothing frames within clothing space 200 as managed in inventory database 252, indicating the condition and status of a wardrobe within clothing space 200, to a user mobile device 260 for output through one or more interfaces of user mobile device 260. In one example, user mobile device 260 may include a connectivity interface for detecting short range wireless broadcasts of status information from one or more of monitoring system 212, monitoring system 222, and monitoring system 232, when within range of the short range wireless broadcasts within clothing space 200. In one example, user mobile device 260 may include general text, email, and other electronic and visual communication interfaces through which a user views information, through which status information for clothing items currently attached to clothing frames within clothing system 200 may also be output. In one example, user mobile system 260 may include a wardrobe application interface 262 specified for managing receipt of status information for clothing items from clothing frame short range broadcasts or transmissions from wardrobe management system 250, analyzing the status information to determine the condition of the wardrobe within clothing space 220 and any recommendations for use or maintenance, and dynamically specifying output of the status information and any recommendations within an interface of user mobile system 260.

In one example, while each clothing frame may function as a standalone hanger for providing a user with status information about the condition of any clothing items temporarily attached to clothing frame 110 to provide information for managing a condition of a wardrobe, when multiple clothing frames configured with monitoring systems are used in conjunction, the combination of clothing frames may provide a system for managing a condition of a selection of clothing items temporarily attached to the clothing frames. In addition, when the multiple clothing frames configured with monitoring systems are used in conjunction with one or more of wardrobe management system 250 and user mobile device 260, a user may specify the management of the condition of a selection of clothing items temporarily attached to the clothing frames.

In one example, one or more of wardrobe management system 250, user mobile device 160, monitoring system 212, monitoring system 222, and monitoring system 232 may selectively be switched between one or more modes, or may concurrently function in multiple modes. In one example, in an organization mode, outputs may be switched, such as switching visual indicators within the display interfaces of each monitoring system, to display an organizational structure of a collection of clothing in clothing space 200 to indicate which clothing frames should be grouped together based on previous usage. In one example, an odor monitoring mode, outputs may be switched, such as switching visual indicators within the display interfaces of each monitoring system, to display an odor condition structure of a collection of clothing in clothing space 200 to indicate which clothing frames are impacted by an adverse odor compound and to provide recommendations for management.

Figure 3:
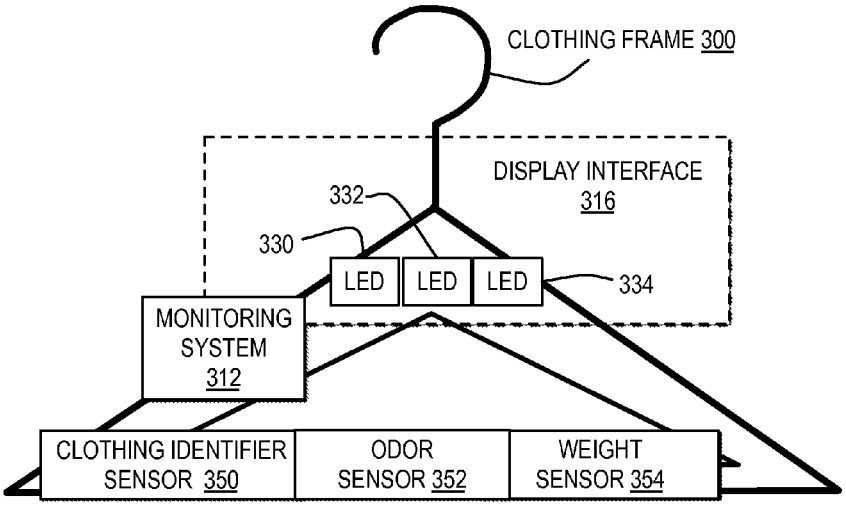
FIG. 3 illustrates one example of a block diagram of display interface and sensor components of a monitoring system distributed within a clothing frame for tracking and indicating status information of any clothing item temporarily attached to the clothing frame.

FIG. 3 illustrates a block diagram of one example of display interface and sensor components of a monitoring system distributed within a clothing frame for tracking and indicating status information of any clothing item temporarily attached to the clothing frame.

In one example, a clothing frame 300 is configured as a traditional triangle frame for holding a clothing item, along with a hook for hanging the triangle frame on a holder. In additional or alternate examples, clothing frame 300 may be configured in alternative forms and shapes. In one example, clothing frame 300 is configured with a monitoring system 312 with one or more components as described with respect to monitoring system 112 in FIG. 1. In another example, clothing frame 300 may be configured with additional or alternate monitoring systems.

In one example, monitoring system 312 includes a display interface 316 specified with an output interface for indicating status information of any clothing item temporarily attached to clothing frame 300. In one example, display interface 316 may be configured directly into the framing material of clothing frame 300 or may be configured in a component that is permanently or temporarily affixed to clothing frame 300.

In one example, display interface 316 may include one or more light emitting diodes (LEDs) dispersed in one or more locations. For example, as illustrated, display interface 316 is configured with an LED 330, and LED 332, and an LED 334. In one example, each of LED 330, LED 332, and LED 334 may be configured to emit a different color of light. For example, LED 330 may be configured to emit a green light, LED 332 may be configured to emit a yellow light, and LED 334 may be configured to emit a red light. In additional or alternate examples, display interface 316 may include additional or alternate types, colors, and numbers of LEDs, including LEDs that are configurable to display different colors. In additional or alternate examples, display interface 316 may also include additional or alternate types of output devices within display interface 316, including, but not limited to, a digital output interface, an audio interface, and a tactile detectable interface.

In one example, monitoring system 312 may select to output status information for one or more clothing items temporarily attached to clothing frame 300 through display interface 316. In one example, in response to monitoring system 312 detecting a clothing item newly attached to clothing frame 300, monitoring system 312 may trigger LED 330 to light up, to alert a user to a new or newly attached clothing item. In one example, in response to monitoring system 312 detecting a clothing item attached to clothing frame 300 has not been worn in a first particular period of time, monitoring system 312 may trigger LED 332 to light up, to alert a user that a clothing item has not been in use for the particular time period. In another example, in response to monitoring system 312 detecting a clothing item attached to clothing frame 300 is no longer applicable for the typical weather in the current season, such as a heavy wool coat during a summer season, monitoring system 312 may trigger LED 334 to light up, to alert a user that the clothing item may need to be stored for the season to maintain the condition of the clothing item. In another example, in response to monitoring system 312 detecting optical measurements for a clothing item attached to clothing frame 300, monitoring system 312 may trigger one or more of LED 330, LED 332, and LED 334 to indicate the age or wear on the clothing item to alert the user to a status of the clothing item in a manner that may alert the user to recommendations to select to store a clothing item, move a clothing item to a different area, or provide other care for a clothing item to improve or maintain the condition of the clothing item.

In one example, a clothing frame may report, via a broadcast or transmission from the connectivity interface of the monitoring system of the clothing frame, when a clothing item is removed from the clothing frame, and an identifier for the clothing item. In one example, each clothing frame individually, or through wardrobe management system 250, may track when clothing items are removed from multiple clothing frames within a particular period of time as an indicator that the clothing items are being worn together. Monitoring system 312 may receive status information from another clothing frame or wardrobe management system 250 indicating that a particular clothing item has been removed and monitoring system 312 may receive specifications from wardrobe management system 250 indicating which clothing items are associated with the removed clothing item. In one example, monitoring system 312 may detect when another clothing item is removed, detect an indicator that the current clothing item attached to monitoring system 312 and the removed clothing item are associated, and trigger one or more of LED 330, LED 332, and LED 334 to indicate the association of the removed clothing item with the current clothing item attached to clothing frame 300.

In another example, wardrobe management system 250 may access environment information related to an environment in which clothing items may be worn. Environmental information may include, but is not limited to, weather information, calendar event information, the clothing choices of others, and other information that is accessible by wardrobe management system 250 regarding the environment in which clothing items may be worn. In one example, wardrobe management system 250 may detect a selection of environment information for a particular time period, determine which types of clothing items are recommended for the particular time period based on the environment information, and output specifications to one or more clothing frames with the recommended types of clothing items. In one example, the specifications output by wardrobe management system 250 may be specified by clothing frame and may specify which selection of LEDs to trigger to indicate whether each clothing frame is recommended. In another example, the specifications output by wardrobe management system 250 may specify one or more recommended or not recommended types of clothing items, where the monitoring system for each clothing frame determines whether the type of clothing item currently attached to the clothing frame matches the specification recommendation and selects which LED within display interface 316 to trigger to indicate whether the clothing item is recommended or not recommended. In another example, the specifications output by wardrobe management system 250 may specify information indicating which selections of clothing items should be grouped together and which LEDs are assigned to each group to enable each monitoring system of each clothing frame may determine a group association for the clothing item current attached to each clothing frame and select LEDs to output within display interface 316 to illustrate the clothing item group, where clothing frames with clothing items in a same grouping may select the same particular LED or combination of LEDs to trigger within display interface 316.

In one example, monitoring system 312 may include one or more types of sensors, where each type of sensor senses indicators of a particular type of status information for any clothing item temporarily attached to clothing frame 300. In one example, one or more sensors of monitoring system 312 may include a clothing identifier sensor 350, an odor sensor 352, and a weight sensor 354. In one example, each of clothing identifier sensor 350, odor sensor 352, and weight sensor 354 may be configured directly into the framing material of clothing frame 300 or may be configured in one or more components that are permanently or temporarily affixed to clothing frame 300.

In one example, clothing identifier sensor 350 may represent a sensor enabled to identify one or more characteristics or identifiers of a clothing item temporarily attached to clothing frame 300. In one example, clothing identifier sensor 350 may include multiple types of sensors for identifying one or more characteristics of identifiers of a clothing item. In addition, clothing identifier sensor 350 may include components for capturing information about a clothing item and may also include components for analyzing information about a clothing item. Monitoring system 312 may also include components for analyzing the captured information about a clothing item received from clothing identifier sensor 350.

In one example, clothing identifier sensor 350 may represent an RFID reader, enabled to read an RFID tag affixed to a clothing item to read an identifier for the clothing item and any other information stored in the RFID tag. In one example, monitoring system 312 may receive the particular identifier scanned by clothing identifier sensor 350 from the RFID tag and send the particular identifier to wardrobe management system 250 to request additional information associated with the particular identifier in a wardrobe database or to store the particular identifier in inventory database 252. In another example, monitoring system 312 may locally store information collected about each particular identifier in an inventory of wardrobe items or may locally broadcast the particular identifier to enable other clothing frames to maintain an updated list of inventory items.

In another example, clothing identifier sensor 350 may represent an optical scanner specified to capture one or more optical images of a clothing item. In one example, clothing identifier sensor 350 or monitoring system 312 may analyze the one or more optical images to detect one or more characteristics of the clothing item from the one or more optical images of the clothing item. In one example, characteristics of a clothing item that may be detected from an optical image may include, but are not limited to, a clothing color, transparency, garment type, fabric type, and fabric condition, along with a clothing identifier.

In one example, odor sensor 352 may represent a sensor that detects one or more chemicals or gas compounds present within an area and determines whether there is mold or other contamination-type odors present. In one example, monitoring system 312 may access the raw sensed data by odor sensor 352, indicating any chemical or gas compounds sensed, and transmit the raw sensed data to wardrobe management system 250, where wardrobe management system 250 may include or access a database of chemical and gas compound data to compare with the sensed data and determine any molds or other contamination-type odors.

In one example, weight sensor 354 may represent a sensor that includes one or more components dispersed along one or more sections of clothing frame 300 that detect the weight of a clothing item temporarily placed on clothing frame 300. In one example, weight sensor 354 may represent a spring-based measurement device for detecting weights by monitoring the tension on one or more springs dispersed throughout clothing frame 310. In another example, weight sensor 254 may represent a piezoelectric-based measurement device for detecting weights by using the piezoelectric effect to measure strain or force and converting the strain or force into electric charge. In one example, monitoring system 312 may monitor for reports from weight sensor 354 of a changing weight of a clothing item after it is temporarily attached to clothing frame 310 as an indicator of a changing condition of the clothing item. In another example, monitoring system 312 may maintain a local inventory, or access inventory database 252, to search for an inventory item identifier by weight to identify the inventory item, where inventory database 252 may include a separate weight assignment for each inventory item.

Figure 4:
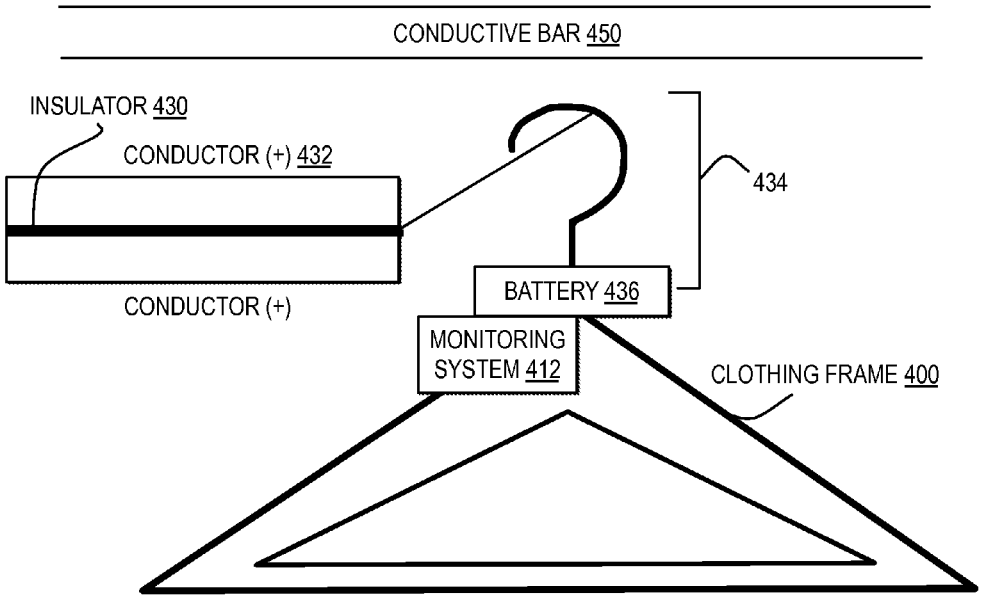
FIG. 4 illustrates one example of a block diagram of a power component of a monitoring system distributed within a clothing frame for tracking and indicating status information of any clothing item temporarily attached to the clothing frame.

FIG. 4 illustrates a block diagram of one example of a power component of a monitoring system distributed within a clothing frame for tracking and indicating status information of any clothing item temporarily attached to the clothing frame.

In one example, a clothing frame 400 is configured as a traditional triangle frame for holding a clothing item, along with a hook for hanging the triangle frame on a holder. In additional or alternate examples, clothing frame 400 may be configured in alternative forms and shapes. In one example, clothing frame 400 is configured with a monitoring system 412 with one or more components as described with respect to monitoring system 112 in FIG. 1. In another example, clothing frame 400 may be configured with additional or alternate monitoring systems.

In one example, a power source component of monitoring system 412 may include a conductive hook element 434 connected via electrical contacts wired to a battery 436 of monitoring system 412, for providing a path for energy to flow from a conductive bar 450 to components of monitoring system 412. In one example, conductive bar 450 is a horizontal bar on to which conductive hook element 434 may be hung, and which also conducts energy. In one example, conductive hook element 434 may include an insulating material illustrated as insulator 430 running through the frame of conductive hook element 434, surrounded by a conductive material illustrated as conductor 432. In another example, conductive hook element 434 may be connected via electrical contacts wired to other components within monitoring system 412. In one example, the electrical contacts for wiring conductive hook element 434 to battery 436 or other components of monitoring system 412 may be implemented using spring-type electrical contacts to provide additional freedom of rotation and translation of conductive hook element 434.

In the example, in addition to or as an alternative to implementing conductive hook element 434, monitoring system 412 may implement one or more types energy storage devices, such as battery 436. In additional or alternate examples, monitoring system 412 may include energy storage devices including, but not limited to, multiple batteries and a super capacitor bank.

Figure 5:
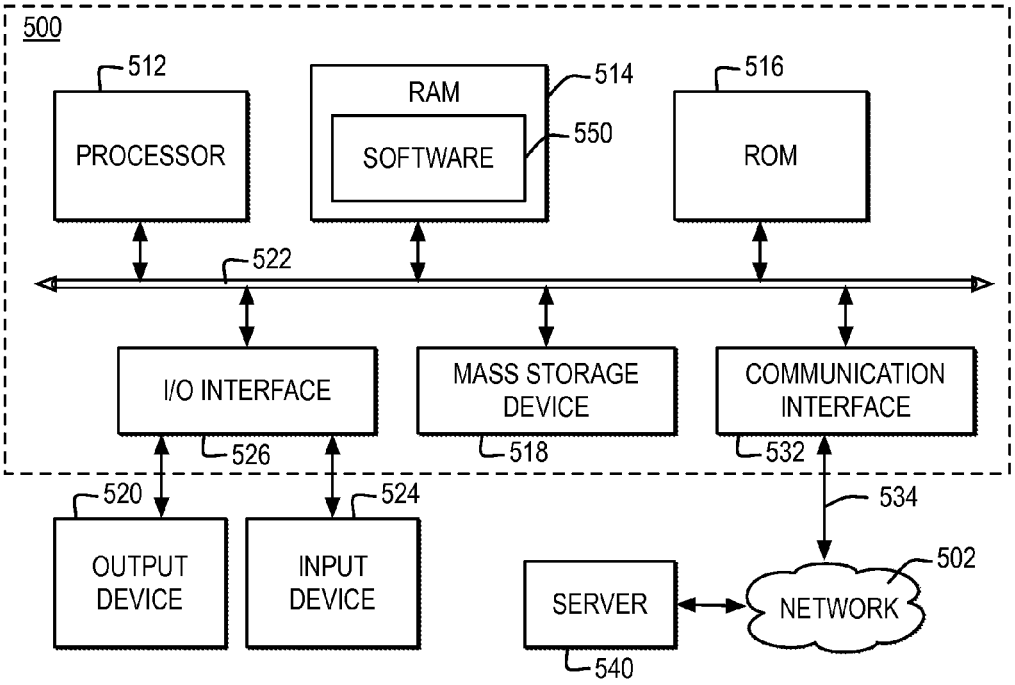
FIG. 5 illustrates one example of a block diagram of a computer system in which one embodiment of the invention may be implemented.

FIG. 5 illustrates a block diagram of one example of a computer system in which one embodiment of the invention may be implemented. The present invention may be performed in a variety of systems and combinations of systems, made up of functional components, such as the functional components described with reference to a computer system 500 and may be communicatively connected to a network, such as network 502.

Computer system 500 includes a bus 522 or other communication device for communicating information within computer system 500, and at least one hardware processing device, such as processor 512, coupled to bus 522 for processing information. Bus 522 preferably includes low-latency and higher latency paths that are connected by bridges and adapters and controlled within computer system 500 by multiple bus controllers. When implemented as a server or node, computer system 500 may include multiple processors designed to improve network servicing power.

Processor 512 may be at least one general-purpose processor that, during normal operation, processes data under the control of software 550, which may include at least one of application software, an operating system, middleware, and other code and computer executable programs accessible from a dynamic storage device such as random access memory (RAM) 514, a static storage device such as Read Only Memory (ROM) 516, a data storage device, such as mass storage device 518, or other data storage medium. Software 550 may include, but is not limited to, code, applications, protocols, interfaces, and processes for controlling one or more systems within a network including, but not limited to, an adapter, a switch, a server, a cluster system, and a grid environment.

Computer system 500 may communicate with a remote computer, such as server 540, or a remote client. In one example, server 540 may be connected to computer system 500 through any type of network, such as network 502, through a communication interface, such as network interface 532, or over a network link that may be connected, for example, to network 502.

In the example, multiple systems within a network environment may be communicatively connected via network 502, which is the medium used to provide communications links between various devices and computer systems communicatively connected. Network 502 may include permanent connections such as wire or fiber optics cables and temporary connections made through telephone connections and wireless transmission connections, for example, and may include routers, switches, gateways and other hardware to enable a communication channel between the systems connected via network 502. Network 502 may represent one or more of packet-switching based networks, telephony based networks, broadcast television networks, local area and wire area networks, public networks, and restricted networks.

Network 502 and the systems communicatively connected to computer 500 via network 502 may implement one or more layers of one or more types of network protocol stacks which may include one or more of a physical layer, a link layer, a network layer, a transport layer, a presentation layer, and an application layer. For example, network 502 may implement one or more of the Transmission Control Protocol/Internet Protocol (TCP/IP) protocol stack or an Open Systems Interconnection (OSI) protocol stack. In addition, for example, network 502 may represent the worldwide collection of networks and gateways that use the TCP/IP suite of protocols to communicate with one another. Network 502 may implement a secure HTTP protocol layer or other security protocol for securing communications between systems.

In the example, network interface 532 includes an adapter 534 for connecting computer system 500 to network 502 through a link and for communicatively connecting computer system 500 to server 540 or other computing systems via network 502. Although not depicted, network interface 532 may include additional software, such as device drivers, additional hardware and other controllers that enable communication. When implemented as a server, computer system 500 may include multiple communication interfaces accessible via multiple peripheral component interconnect (PCI) bus bridges connected to an input/output controller, for example. In this manner, computer system 500 allows connections to multiple clients via multiple separate ports and each port may also support multiple connections to multiple clients.

In one embodiment, the operations performed by processor 512 may control the operations of flowchart of FIGS. 6-10 and other operations described herein. Operations performed by processor 512 may be requested by software 550 or other code or the steps of one embodiment of the invention might be performed by specific hardware components that contain hardwired logic for performing the steps, or by any combination of programmed computer components and custom hardware components. In one embodiment, one or more components of computer system 500, or other components, which may be integrated into one or more components of computer system 500, may contain hardwired logic for performing the operations of flowcharts in FIGS. 6-10.

In addition, computer system 500 may include multiple peripheral components that facilitate input and output. These peripheral components are connected to multiple controllers, adapters, and expansion slots, such as input/output (I/O) interface 526, coupled to one of the multiple levels of bus 522. For example, input device 524 may include, for example, a microphone, a video capture device, an image scanning system, a keyboard, a mouse, or other input peripheral device, communicatively enabled on bus 522 via I/O interface 526 controlling inputs. In addition, for example, output device 520 communicatively enabled on bus 522 via I/O interface 526 for controlling outputs may include, for example, one or more graphical display devices, audio speakers, and tactile detectable output interfaces, but may also include other output interfaces. In alternate embodiments of the present invention, additional or alternate input and output peripheral components may be added.

With respect to FIG. 5, the present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Those of ordinary skill in the art will appreciate that the hardware depicted in FIG. 5 may vary. Furthermore, those of ordinary skill in the art will appreciate that the depicted example is not meant to imply architectural limitations with respect to the present invention.

Figure 6:
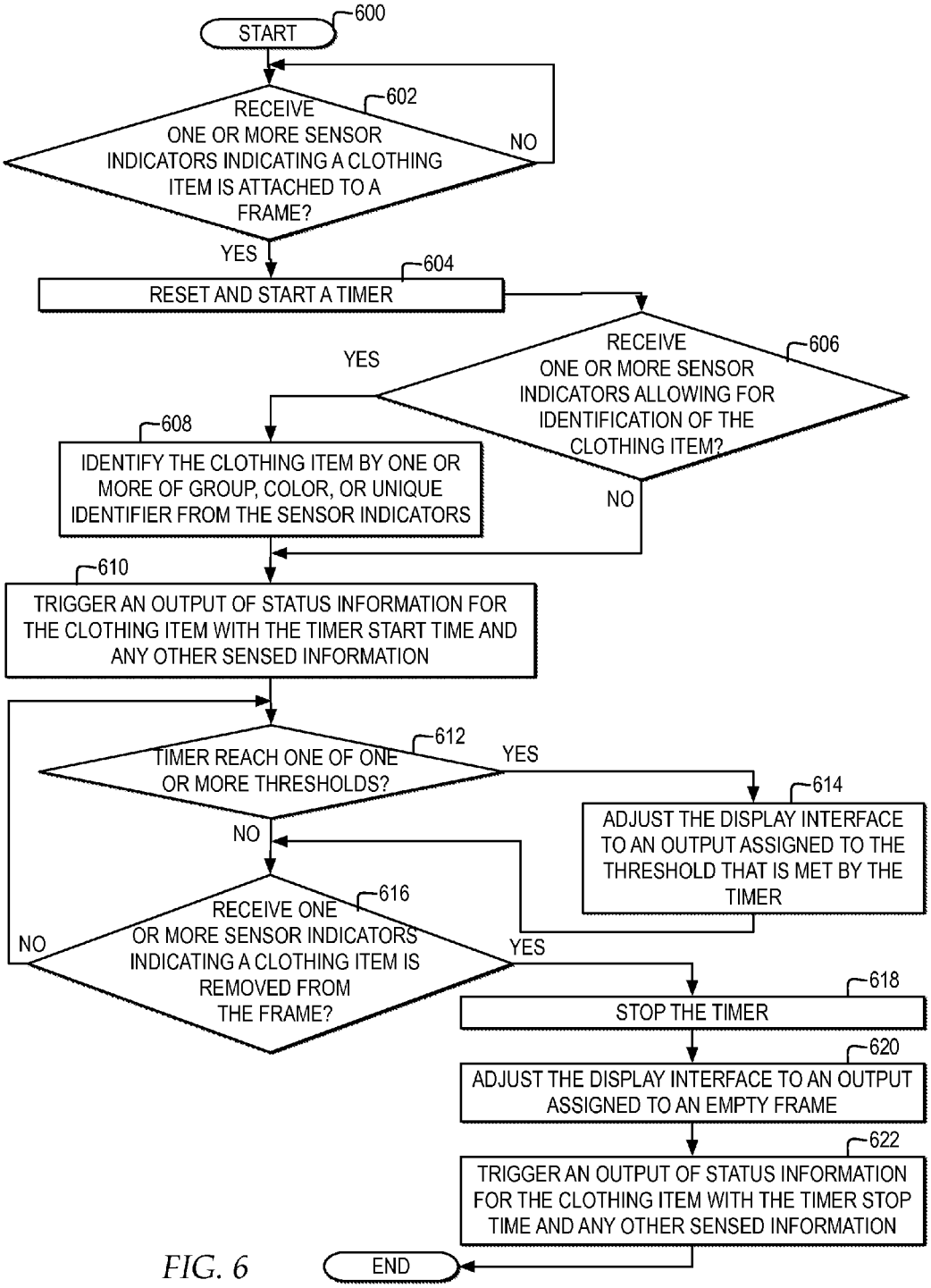
FIG. 6 illustrates a high level logic flowchart of a process and computer program product for monitoring a status and amount of time a clothing item is attached to a clothing frame.

FIG. 6 illustrates a high level logic flowchart of a process and computer program product for monitoring a status and amount of time a clothing item is attached to a clothing frame.

In one example, the process and program starts at block 600 and thereafter proceeds to block 602. Block 602 illustrates a determination whether a monitoring system receives one or more sensor indicators indicating a clothing item is attached to a frame. At block 602, depending on which type of sensors the monitoring system implements, one or more different types of sensor indicators may indicate that a clothing item is attached to a frame. In one example, a sensor indicator from a weight sensor may indicate when a weight measurement has increased, which is an indicator that a clothing item is attached to a frame. In another example, a sensor indicator from an optical sensor may include when an optical image of a clothing item is captured of a clothing item attached to the clothing frame, which is an indicator that a clothing item is attached to a frame. In another example, a sensor indicator from an RFID reader sensor may include an identifier read from an RFID attached to a clothing item, which is an indicator that a clothing item is attached to a frame.

At block 602, when the monitoring system receives one or more sensor indicators indicating a clothing item is attached to a frame, the process passes to block 604. Block 604 illustrates resetting and starting a time, and the process passes to block 606.

Block 606 illustrates a determination whether the monitoring system receives one or more sensor indicators allowing for identification of the clothing item. In one example, identification of a clothing item may include one or more types of identification including, but not limited to, a group association for a clothing item, a color of the clothing item, or a unique identifier. In one example, a group association for a clothing item may include grouping clothing items of a same type in one group, grouping clothing items that have been worn together or are recommended to be worn together in one group, and other groupings specified by a user. In one example, a monitoring system may maintain or access an inventory database of clothing items stored by one or more of weight, optical image characteristics, and RFID identifiers. In one example, a sensor indicator from a weight sensor may indicate a weight measurement, which is an indicator may allow for identification of the clothing item by comparing the weight with one or more weights associated with clothing item identifiers in an inventory database. In one example, a sensor indicator from an optical sensor may indicate include an optical image, which is an indicator that may allow for identifying a color, group, or identifier for a clothing item when the clothing item is attached to a frame. In another example, a sensor indicator from an RFID reader sensor may include an identifier read from an RFID attached to a clothing item, which is an indicator of an identification of a clothing item. At block 608, if one or more sensor indicators are not received that allow for identification of the clothing item, then the process passes to block 610. At block 608, if one or more sensor indicators are received that allow for identification of the clothing item, then the process passes to block 608. Block 608 illustrates identifying the clothing item by one or more of a group, color and unique identifier from the sensor indicators, and the process passes to block 610.

Block 610 illustrates triggering an output of status information for the clothing item with the timer start time and any other sensed information. Next, block 612 illustrates a determination whether the timer has reached one of one or more thresholds. At block 612, if the timer has not reached one of one or more thresholds, then the process passes to block 616. At block 612, if the timer has reached one of one or more thresholds, then the process passes to block 614. Block 614 illustrates adjusting the display interface to an output assigned to the threshold that is met by the timer, and the process passes to block 616.

Block 616 illustrates a determination whether one or more sensor indicators are received that indicate a clothing item is removed from a frame. If one or more sensor indicators are received indicating a clothing item is removed from a frame, then the process passes to block 618. Block 618 illustrates stopping the timer. Next, block 620 illustrates adjusting the display interface to an output assigned to an empty frame. Thereafter, block 622 illustrates triggering an output of status information or the clothing item with the timer stop time and any other sensed information, and the process ends.

Figure 7:
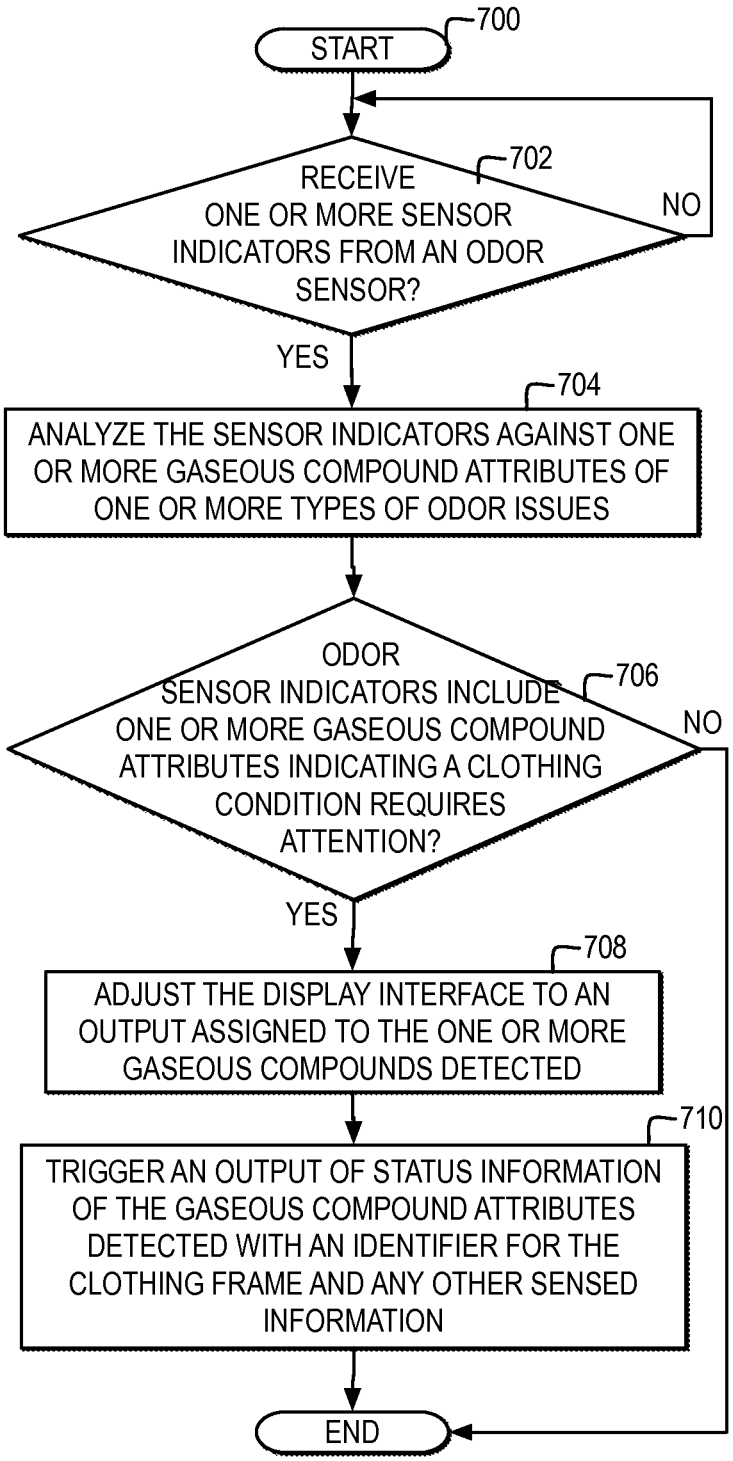
FIG. 7 illustrates a high level logic flowchart of a process and computer program product for monitoring whether any odor condition exists that requires attention to maintain the condition of one or more clothing items.

FIG. 7 illustrates a high level logic flowchart of a process and computer program product for monitoring whether any odor condition exists that requires attention to maintain the condition of one or more clothing items.

In one example, the process and computer program product start at block 700 and thereafter proceed to block 702. Block 702 illustrates a determination whether one or more sensor indicators are received from an odor sensor. At block 702, if one or more sensor indicators are received from an odor sensor, then the process passes to block 704. Block 704 illustrates analyzing the sensor indicators against one or more gaseous compound attributes of one or more types of odor issues that require attention to maintain the condition of one or more clothing items. Next, block 706 illustrates a determination whether the odor sensor indicators include one or more gaseous compound attributes indicating a clothing condition that requires attention. At block 706, if the odor sensor indicators do not include one or more gaseous compound attributes indicating clothing condition that requires attention, then the process ends. At block 706, if the odor sensor indicators do not include one or more gaseous compound attributes indicating clothing condition that requires attention, then the process passes to block 708. Block 708 illustrates adjusting the display interface to an output assigned to the one or more gaseous compounds detected. Next, block 710 illustrates triggering an output of status information of the gaseous compound attributes detected with an identifier for the clothing frame and any other sensed information, and the process ends.

Figure 8:
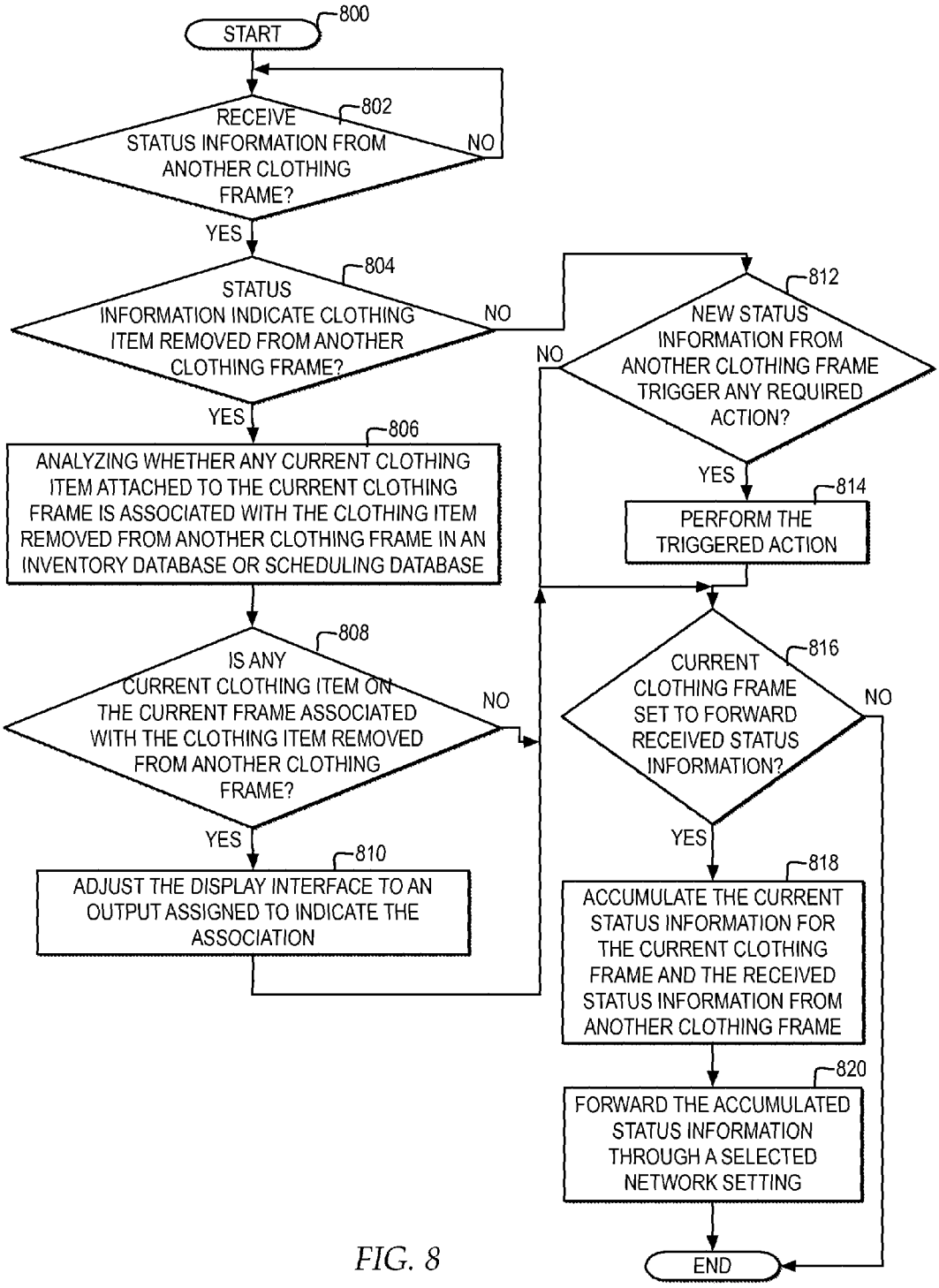
FIG. 8 illustrates a high level logic flowchart of a process and computer program product for managing status information received from another clothing frame by a current clothing frame.

FIG. 8 illustrates a high level logic flowchart of a process and computer program product for managing status information received from another clothing frame by a current clothing frame.

In one example, the process and program starts at block 800 and thereafter proceeds to block 802. Block 802 illustrates a determination whether status information is received from another clothing frame. At block 802, if status information is received from another clothing frame, then the process passes to block 804. Block 804 illustrates a determination whether the status information indicates a clothing item removed from another clothing frame.

At block 804, if the status information indicates that a clothing item is removed from another clothing frame, then the process passes to block 806. Block 806 illustrates analyzing whether any current clothing item attached to the current clothing frame is associated with the clothing item removed from another clothing frame in an inventory database or scheduling database accessible to the current frame, such as by group, color, or other association. Next, block 808 illustrates a determination whether any current clothing item on the current frame is associated with the clothing item removed from another clothing frame.

At block 808, if any current clothing item on the current frame is associated with the clothing item removed from another clothing frame, then the process passes to block 810. Block 810 illustrates adjusting a display interface to an output assigned to indicate the association of the current clothing item on the clothing frame with the clothing item removed from another clothing frame, and the process passes to block 812.

At block 808, if any current clothing item on the current frame is not associated with the clothing item removed from another clothing frame, then the process passes to block 812. Block 812 illustrates a determination whether the new status information from another clothing frame triggers any other required action. In one example, a monitoring system of a clothing frame may be specified with actions to be performed in response to selected status information. At block 812, if the new status information from another clothing frame triggers any other required action, then the process passes to block 814. Block 814 illustrates performing the triggered action, and the process passes to block 816. Returning to block 812, if the new status information from another clothing frame does not triggered any other required action, then the process passes to block 816.

Block 816 illustrates a determination whether the current clothing frame is set to forward received status information, such as being set to transmit status information to a wardrobe management system or to short range wireless broadcast received status information. If the current clothing frame is set to forward received status information, then the process passes to block 818. Block 818 illustrates accumulating the current status information for the current clothing frame and the received status information from another clothing frame. Block 820 illustrates forwarding the accumulated status information through a selecting network setting, such as transmitting the accumulated status information to a network address for the wardrobe management system, and the process ends.

Figure 9:
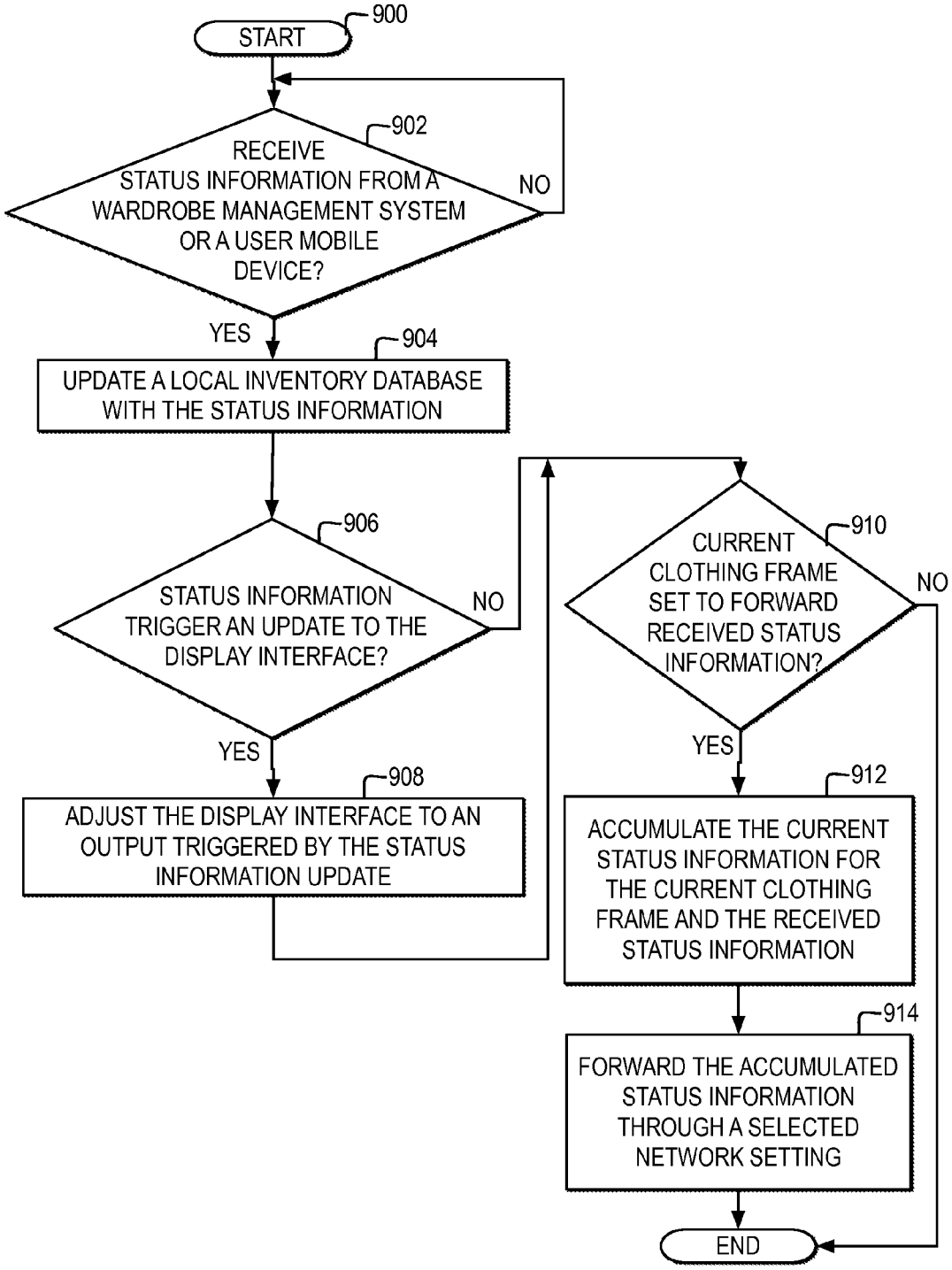
FIG. 9 illustrates a high level logic flowchart of a process and computer program product for managing status information received from a wardrobe management system or a user mobile device by a current clothing frame.

FIG. 9 illustrates a high level logic flowchart of a process and computer program product for managing status information received from a wardrobe management system or a user mobile device by a current clothing frame.

In one example, the process and program start at block 900 and thereafter proceed to block 902. Block 902 illustrates a determination whether status information is received from a wardrobe management system or a user mobile device. At block 902, if status information is received from a wardrobe management system or a user mobile device, then the process passes to block 904. Block 904 illustrates updating a local inventory database with the status information. Next, block 906 illustrates a determination whether the status information triggers an update to the display interface for the clothing frame. At block 906, if the status information does not trigger an update to the display interface, then the process passes to block 910. At block 906, if the status information triggers an update to the display interface, then the process passes to block 908. Block 908 illustrates adjusting the display interface to an output triggered by the status information update. Next, block 910 illustrates a determination whether the current clothing frame is set to forward received status information. At block 910, if the current clothing frame is not set to forward received status information, then the process ends. At block 910, if the current clothing frame is set to forward received status information, then the process passes to block 912. Block 912 illustrates accumulating the current status information for a current clothing frame and the received status information. Next, block 914 illustrates forwarding the accumulated status information through a selected network setting, such as through a short range wireless network broadcast detectable both other clothing frames within a particular range of the clothing frame, and the process ends.

Figure 10:
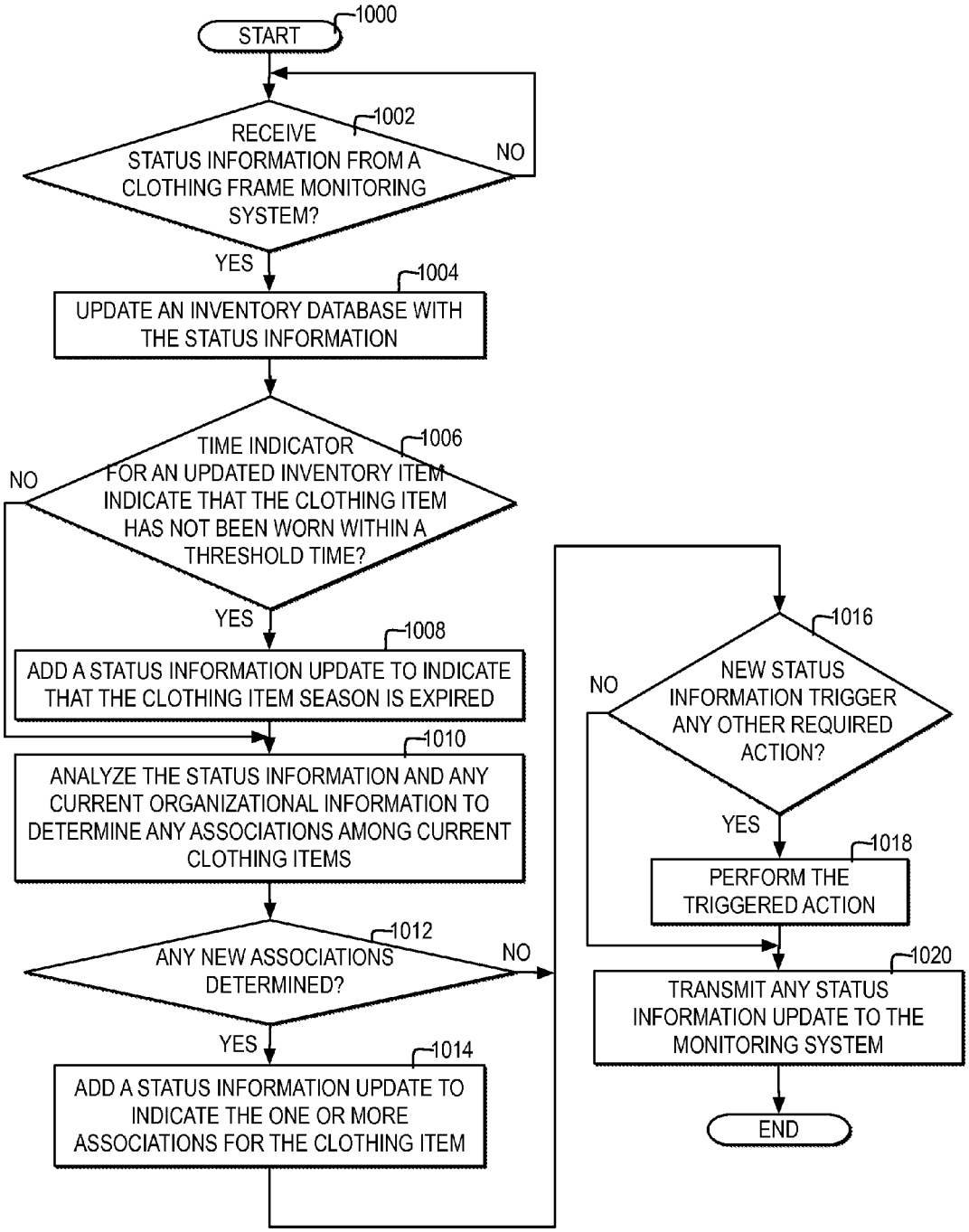
FIG. 10 illustrates a high level logic flowchart of a process and computer program product for managing status information received by a wardrobe management system or a user mobile device from a current clothing frame.

FIG. 10 illustrates a high level logic flowchart of a process and computer program product for managing status information received by a wardrobe management system or a user mobile device from a current clothing frame.

In one example, the process or computer program starts at block 1000 and thereafter proceeds to block 1002. Block 1002 illustrates a determination whether status information is received by a wardrobe management system or user mobile device from a clothing frame monitoring system. At block 1002, if status information is received, then the process passes to block 1004. Block 1004 illustrates updating an inventory database with the status information. Next, block 1006 illustrates a determination whether a time indicator for an updated inventory item indicates that the clothing item has not been worn within a threshold time. In one example, a threshold time may be set to indicate a current season during which a clothing item is typically current. At block 1006, if the time indicator does not indicate at the clothing item has not been worn within a threshold time, then the process passes to block 1010. At block 1006, if the time indicator does indicate that the clothing item has not been worn within a threshold time, then the process passes to block 1008. Block 1008 illustrates adding a status information update to indicate that the clothing item season is expired, and the process passes to block 1010.

Block 1010 illustrates analyzing the status information and any current organizational information, such as, but not limited to, the weather, scheduled events, and others' scheduled events, to determine any associations among clothing items, where an association may indicate one or more groupings of one or more clothing items. Next, block 1012 illustrates a determination whether any new associations are determined. At block 1012, if no new associations are determined, then the process passes to block 1016. At block 1012, if one or more new associations are determined, then the process passes to block 1014. Block 1014 illustrates adding a status information update to indicate the one or more associations for the clothing item, and the process passes to block 1016. In one example, the status information update may specify one or more types of display output for a particular clothing frame to output based on the one or more associations for the clothing item. In another example, the status information update may specify one or more particular types of associations for a clothing item, where the monitoring system for the clothing frame determines the types of display outputs to control based on the selected associations.

Block 1016 illustrates a determination whether the new status information triggers any other required action. At block 1016, if the new status information does not trigger any other required action, then the process passes to block 1020. At block 1018 illustrates performing the triggered action, and the process passes to block 1020. A user may specify one or more types of actions to be taken based on different types of status information. In one example, if an indicator in the status information includes indicators of particular types of odors, the status indicator may trigger an action of adding a clothing item to a laundry list or calendar.

Block 1020 illustrates transmitting any status information update to the monitoring system for one or more clothing frames, and the process ends. In one example, the status information updates may be transmitted to only the reporting clothing frame monitoring system. In another example, a user mobile device may control a short range wireless broadcast the status information updates within a particular broadcast range.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification specify the presence of stated features, integers, steps, operations, elements, and/or components, but not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the one or more embodiments of the invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

While the invention has been particularly shown and described with reference to one or more embodiments, it will be understood by those skilled in the art that various changes in form and detail may be made therein without departing from the spirit and scope of the invention.

What is claimed is:

1. A system, comprising:

one or more processors communicatively connected with a memory, one or more output interfaces, one or more connectivity interfaces and one or more sensors attached to a clothing frame;

the one or more sensors operative to sense one or more indicators of a status of a clothing item attached to the clothing frame;

the one or more sensors further comprising a radio frequency identifier reader installed within the one or more sensors attached to the clothing frame and operative to read an identifier for the clothing item from a radio frequency identifier chip on the clothing item;

the one or more processors operative to determine status information indicating a condition of the clothing item based on the one or more indicators;

the one or more processors operative to selectively adjust an output interface to display the status information;

the one or more processors operative to communicate the status information to one or more additional clothing frames via the one or more connectivity interfaces;

the one or more processors operative to communicate the identifier via the one or more connectivity interfaces to a monitoring system, wherein the monitoring system accesses additional information associated with the identifier from a wardrobe database of a history of each detection of the identifier and broadcasts the identifier and the additional information to the clothing hangar and to one or more additional clothing hangers to update one or more additional inventory databases with the identifier and the additional information in one or more additional memories; and the one or more processors operative to update an inventory database with the identifier and with the additional information, received from the monitoring system via the one or more connectivity interfaces, in the one or more memories to locally maintain an updated list of inventory items.

2. The system of claim 1, wherein the one or more output interfaces comprise a plurality of light emitting diodes configured in a position of the clothing frame that is visible when the clothing item is attached to the clothing frame, each of the light emitting diodes configured to emit one or more selected colors when triggered.

3. The system of claim 1, further comprising:

one or more power sources for providing power to the one or more output interfaces, the one or more connectivity interfaces, the one or more sensors, and the one or more processors; and the one or more power sources comprising a conductive arm of the clothing frame connected to a battery, the conductive arm connectively affixable to a conductive bar for holding the clothing frame.

4. The system of claim 1, further comprising:

one or more power sources for providing power to the one or more output interfaces, the one or more connectivity interfaces, the one or more sensors, and the one or more processors;

the one or more power sources comprising a receiver for receiving and providing wireless energy.

5. The system of claim 1, wherein the one or more sensors further comprise an odor sensor for sensing one or more gaseous compounds indicative of a selection of one or more contamination odor conditions and wherein the one or more processors trigger an output to the one or more output interfaces to indicate the one or more contamination odor conditions.

6. The system of claim 1, further comprising:

the one or more connectivity interfaces operative to receive a broadcast of a database of a plurality of weights each associated with a separate clothing item identifier from among a plurality of clothing item identifiers;

the one or more sensors further comprising a weight sensor comprising a plurality of spring based measuring devices for measuring a weight of the clothing item; and the one or more processors operative to compare the weight with the database to identify a particular weight from among the plurality of weights associated with a particular clothing item identifier from among the plurality of clothing item identifiers to identify the a particular clothing item identifier associated with the particular weight in the database.

7. The system of claim 1, wherein the one or more sensors further comprise an optical sensor for sensing one or more of a transparency, a fabric type, and a fabric condition of the clothing item.

8. The system of claim 1, further comprising:

the one or more processors operative, in response to detecting from the one or more indicators from the one or more sensors that the clothing item is attached to the clothing frame, to start a timer to track an amount of time the clothing item is attached to the clothing frame;

the one or more processors operative, in respond to detecting from the one or more indicators from the one or more sensors that the clothing item is removed from the clothing frame, to stop the timer;

the one or more processors operative to compare the amount of time on the timer that the clothing item is attached to the clothing frame with one or more thresholds; and the one or more processors operative, in response to the amount of time on the timer that the clothing is attached to the clothing frame reaching a particular threshold of the one or more thresholds, to adjust an output in the one or more output interfaces to indicate the particular threshold is met.

9. The system of claim 1, further comprising:

the one or more connectivity interfaces operative to receive other status information from the one or more additional clothing frames indicating that another clothing item has been removed from one of the one or more additional clothing frames;

the one or more processors operative to determine whether the clothing item on the clothing frame is associated with the another clothing item; and the one or more processors operative to, in response to determining the clothing item on the clothing frame is associated with the another clothing item, to adjust an output to the one or more output interfaces to indicate the clothing item is associated with the another clothing item.

10. The system of claim 1, further comprising:

the one or more connectivity interfaces operative to receive other status information from the one or more additional clothing frames about one or more other clothing items from one or more ranges of connectivity, wherein the one or more additional clothing frames broadcast range is only a short range wireless broadcast that is detectable by the one or more connectivity interfaces when the clothing frame is physically positioned within a particular range of the one or more additional clothing frames;

the one or more processors operative to accumulate the status information and the other status information into accumulated status information; and the one or more processors operative to transmit the accumulated status information to a wardrobe management system at a remote network location over a wireless local area network.

11. The system of claim 1, wherein the one or more connectivity interfaces further comprise one or more of a short range wireless broadcast controller and remote transmission controller.

12. The system of claim 1, further comprising:

one or more second processors connected with one or more second output interfaces, one or more second connectivity interfaces and one or more second sensors attached to a second clothing frame;

the one or more second sensors operative to sense one or more second indicators of a second status of a second clothing item attached to the second clothing frame;

the one or more second processors operative to determine second status information for the second clothing item based on the one or more second indicators;

the one or more second processors operative to communicate the second status information to the clothing frame via a short range wireless broadcast from the second one or more connectivity interfaces;

the one or more connectivity interfaces of the clothing frame operative to receive the second status information from the short range wireless broadcast; and the one or more processors operative to determine status information for the clothing item based on the one or more indicators for one or more current mode settings from among a plurality of mode settings, the plurality of mode settings comprising an organizational mode, an odor monitoring mode, and a status mode, wherein the status information for the organization mode tracks one or more clothing items indicated as removed from the clothing frame and the second clothing frame during a particular time period and replaced on the clothing frame after the particular time period, wherein the status information for the odor monitoring mode tracks the one or more clothing items sensed with an odor compound that is specified as adverse odor compound on the clothing frame and the second clothing frame, wherein the status information for the status mode tracks whether an amount of time that the one or more clothing items detected as positioned on the clothing frame exceeds a threshold;

the one or more processors operative to selectively adjust an output interface to display the status information for the one or more current mode settings, wherein the output interface in the organization mode displays the status information for the clothing item and the second clothing item indicating at least one selection of the clothing item and the second clothing item grouped together in each separate group from among a plurality of groups based on being concurrently removed during a particular time period, wherein the output interface in the odor monitoring mode displays the status information for the adverse odor compound indicating at least one selection of the clothing item and the second clothing item require cleaning, wherein the output interface in the status mode displays the status information for the clothing item and the second clothing item indicating the threshold exceeded; and the one or more processors operative to communicate the status information to second clothing frame via the one or more connectivity interfaces, wherein the second clothing frame comprises the second output interface to display the status information and the second status information for the current mode setting, wherein in the organization mode a same visual indicator is selected in the output interface and the second separate output interface for each separate group, wherein in the odor monitoring mode the same visual indicator is selected in the output interface and the second output interface for each odor company specified as the adverse odor compound requiring maintenance, wherein in the status mode a same visual indicator is selected in the output interface and the second output interface for the threshold exceeded.

13. A method, comprising:

attaching a monitoring system comprising one or more processors communicatively connected with a memory, one or more output interfaces, one or more connectivity interfaces and one or more sensors, to a clothing frame;

sensing, by the one or more sensors, one or more indicators of a status of a clothing item attached to the clothing frame, the one or more sensors attached to the clothing frame and connected to one or more processors, one or more output interfaces, and one or more connectivity interfaces;

reading, by the one or more sensors, an identifier from a radio frequency identifier chip attached to the clothing item;

identifying, by the one or more processors, the clothing item from the identifier;

determining, by the one or more processors, status information indicating a condition of the clothing item based on the one or more indicators;

selectively adjusting, by the one or more processors, an output interface to display the status information;

communicating, by the one or more processors, the status information to one or more additional clothing frames via the one or more connectivity interfaces;

communicating, by the one or more processors, the identifier via the one or more connectivity interfaces to a monitoring system, wherein the monitoring system accesses additional information associated with the identifier from a wardrobe database of a history of each detection of the identifier and broadcasts the identifier and the additional information to the clothing hangar and to one or more additional clothing hangers to update one or more additional inventory databases with the identifier and the additional information in one or more additional memories; and updating, by the one or more processors, an inventory database with the identifier and with the additional information, received from the monitoring system via the one or more connectivity interfaces, in the one or more memories to locally maintain an updated list of inventory items.

14. The method of claim 13, further comprising:

sensing, by the one or more sensors, one or more gaseous compounds indicative of a selection of one or more contamination odor conditions; and controlling, by the one or more processors, an output to the one or more output interfaces to indicate the one or more contamination odor conditions.

15. The method of claim 13, further comprising:

receiving, by the one or more connectivity interfaces, a broadcast of a database of a plurality of weights each associated with a separate clothing item identifier from among a plurality of clothing item identifiers;

sensing, by the one or more sensors, from a plurality of spring based measuring devices, a weight of the clothing item; and identifying, by the one or more processors, the clothing item by comparing the weight with the database to identify a particular weight from among the plurality of weights associated with a particular clothing item identifier from among the plurality of clothing item identifiers to identify the a particular clothing item identifier associated with the particular weight in the database.

16. The method of claim 13, further comprising:

receiving, by the one or more connectivity interfaces, other status information from the one or more additional clothing frames indicating that another clothing item has been removed from one of the one or more additional clothing frames;

determining, by the one or more processors, whether the clothing item on the clothing frame is associated with the another clothing item; and in response to determining the clothing item on the clothing frame is associated with the another clothing item, adjusting, by the one or more processors, an output to the one or more output interfaces to indicate the clothing item is associated with the another clothing item.

17. The method of claim 13, further comprising:

attaching a second monitoring system comprising one or more second processors connected with one or more second output interfaces, one or more second connectivity interfaces and one or more second sensors, to a second clothing frame;

sensing, by the one or more second sensors, one or more second indicators of a second status of a second clothing item attached to the second clothing frame;

determining, by the one or more second processors, second status information for the second clothing item based on the one or more second indicators;

communicating, by the one or more second processors, the second status information to the clothing frame via a short range wireless broadcast from the second one or more connectivity interfaces;

receiving, by the one or more connectivity interfaces, the second status information from the short range wireless broadcast;

determining, by the one or more processors, the status information for the clothing item based on the one or more indicators for one or more current mode settings from among a plurality of mode settings, the plurality of mode settings comprising an organizational mode, an odor monitoring mode, and a status mode, wherein the status information for the organization mode tracks one or more clothing items indicated as removed from the clothing frame and the second clothing frame during a particular time period and replaced on the clothing frame after the particular time period, wherein the status information for the odor monitoring mode tracks the one or more clothing items sensed with an odor compound that is specified as adverse odor compound on the clothing frame and the second clothing frame, wherein the status information for the status mode tracks whether an amount of time that the one or more clothing items detected as positioned on the clothing frame exceeds a threshold;

selectively adjusting, by the one or more processors, an output interface to display the status information for the one or more current mode settings, wherein the output interface in the organization mode displays the status information for the clothing item and the second clothing item indicating at least one selection of the clothing item and the second clothing item grouped together in each separate group from among a plurality of groups based on being concurrently removed during a particular time period, wherein the output interface in the odor monitoring mode displays the status information for the adverse odor compound indicating at least one selection of the clothing item and the second clothing item require cleaning, wherein the output interface in the status mode displays the status information for the clothing item and the second clothing item indicating the threshold exceeded; and communicating, by the one or more processors, the status information to second clothing frame via the one or more connectivity interfaces, wherein the second clothing frame comprises the second output interface to display the status information and the second status information for the current mode setting, wherein in the organization mode a same visual indicator is selected in the output interface and the second separate output interface for each separate group, wherein in the odor monitoring mode the same visual indicator is selected in the output interface and the second output interface for each odor company specified as the adverse odor compound requiring maintenance, wherein in the status mode a same visual indicator is selected in the output interface and the second output interface for the threshold exceeded.

18. A computer program product comprising one or more non-transitory computer readable storage devices and program instructions, stored on at least one of the one or more storage devices, the stored program instructions comprising:

program instructions to control a monitoring system comprising one or more processors communicatively connected with a memory, one or more output interfaces, one or more connectivity interfaces and one or more sensors, to a clothing frame;

program instructions to sense, by the one or more sensors, one or more indicators of a status of a clothing item attached to the clothing frame, the one or more sensors attached to the clothing frame and connected to one or more processors, one or more output interfaces, and one or more connectivity interfaces;

program instructions to read, by the one or more sensors, an identifier from a radio frequency identifier chip attached to the clothing item:

program instructions to identify, by the one or more processors, the clothing item from the identifier;

program instructions to determine status information indicating a condition of the clothing item based on the one or more indicators;

program instructions to selectively adjust an output interface to display the status information;

program instructions to communicate the status information to one or more additional clothing frames via the one or more connectivity interfaces;

program instructions to communicate the identifier via the one or more connectivity interfaces to a monitoring system, wherein the monitoring system accesses additional information associated with the identifier from a wardrobe database of a history of each detection of the identifier and broadcasts the identifier and the additional information to the clothing hangar and to one or more additional clothing hangers to update one or more additional inventory databases with the identifier and the additional information in one or more additional memories; and program instructions to update an inventory database with the identifier and with the additional information, received from the monitoring system via the one or more connectivity interfaces, in the one or more memories to locally maintain an updated list of inventory items.

* * * * *